United States Patent [19]

Wassenhoven

[11] Patent Number: 4,815,269

[45] Date of Patent: Mar. 28, 1989

[54] SILVER OPENING AND FEEDING DEVICE FOR AN OPEN-END SPINNING DEVICE

[75] Inventor: Heinz-Georg Wassenhoven, Moenchengladbach, Fed. Rep. of Germany

[73] Assignee: W. Schlafhorst & Co., Fed. Rep. of Germany

[21] Appl. No.: 170,863

[22] Filed: Mar. 21, 1988

[30] Foreign Application Priority Data

Mar. 20, 1987 [DE] Fed. Rep. of Germany ..... 3709322

[51] Int. Cl.[4] ..... D01H 7/888; D01H 7/892

[52] U.S. Cl. ..... 57/412; 57/301; 57/411

[58] Field of Search ..... 57/300–302, 57/408–412; 19/82–86, 96, 105, 112

[56] References Cited

U.S. PATENT DOCUMENTS

| | | | |
|---|---|---|---|
| 3,439,488 | 4/1969 | Bucil et al. | 57/412 |
| 3,797,218 | 3/1974 | Landuehrkamp et al. | 57/301 |
| 3,828,539 | 8/1974 | Croasdale et al. | 57/412 |
| 4,024,699 | 5/1977 | Goldammer et al. | 57/412 |
| 4,201,037 | 5/1980 | Artzt et al. | 57/301 |
| 4,254,612 | 3/1981 | Miyamoto et al. | 57/411 |

FOREIGN PATENT DOCUMENTS

| | | |
|---|---|---|
| 0010258 | 4/1980 | European Pat. Off. . |
| 1914115 | 9/1970 | Fed. Rep. of Germany . |
| 2312169 | 9/1973 | Fed. Rep. of Germany . |
| 2248396 | 4/1974 | Fed. Rep. of Germany . |
| 2448584 | 4/1976 | Fed. Rep. of Germany . |
| 2648715 | 5/1978 | Fed. Rep. of Germany . |
| 3221385 | 12/1983 | Fed. Rep. of Germany . |

*Primary Examiner*—John Petrakes

*Attorney, Agent, or Firm*—Shefte, Pinckney & Sawyer

[57] ABSTRACT

A silver feed and opening device for open-end spinning applications comprises a housing having a rotatable opening roller associated with a pivotable guide plate having a first sliver guide portion for directing incoming sliver to the opening roller, a second arcuate fiber guide portion extending along a portion of the opening roller circumference in its direction of rotation, and a third debris guide portion extending outwardly from the opening roller and defining with the housing a debris discharge opening. The guide plate is of a unitary one-piece construction without joints between individual portions to prevent undesirable fiber accumulation which tends to occur in conventional devices. Each of the fiber and debris guide portions of the guide plate are spaced sufficiently from the sidewalls of the housing to form side slots which are a multiple of the thickness of the fibers, thereby to prevent accumulation thereof between the guide plate and the housing.

7 Claims, 2 Drawing Sheets

SILVER OPENING AND FEEDING DEVICE FOR AN OPEN-END SPINNING DEVICE

BACKGROUND OF THE INVENTION

The present invention relates generally to textile open-end yarn spinning operations and, more particularly, to a device for opening sliver into individual fibers and feeding the fibers to an open-end spinning device.

In open-end spinning operations, a textile sliver consisting of individual fibers, which through previous processing have been substantially parallelized with respect to one another, are opened, i.e. separated into essentially individual fibers, and fed to the spinning chamber of an open-end spinning device. Various devices exist for performing this sliver opening and feeding operation. One basic type of feeding and opening device essentially includes a housing in which a sliver opening roller is rotatably mounted, in combination with a sliver delivery member, a feed roller and some form of spring-biased pivotable or otherwise movable guide member or plate associated with the feed roller for cooperatively directing incoming sliver to the opening roller through a suitable sliver intake opening in the housing. The housing and the opening roller are cooperatively arranged to define a fiber guide pathway through the opening device through which the associated open-end spinning device applies a vacuum, for directing the individualized fibers into the spinning chamber of the open-end spinning device. In sliver feeding and opening devices of this type, an opening may be provided in the housing through which dirt and debris in the sliver may be separated from the individual fibers during the opening operation.

As will be understood, the individual fibers are relatively fine with a rather small diameter so that the fibers may tend to settle and become lodged at various locations within the housing, even at very small or fine joints or areas of unevenness at the junctures between adjacent components of the housing as well as at housing edges and corners. Fibers so caught then may pose an impediment to the normal movement of other fibers which may catch on the previously-caught fibers. In time, a flock or tuft of fibers may accumulate and significantly disturb the normal fiber flow through the housing. Further, errors or even a breakage of the yarn produced by the spinning device may occur if such a flock ultimately dislodges and passes into the spinning chamber of the open-end spinning device.

As aforementioned, sliver feeding and opening devices for open-end spinning operations are known wherein a separating opening is provided in the housing through which debris in the sliver, e.g. husk remnants, sand, dirt, finish, etc., may be expelled. One example of this type of opening and feeding device is disclosed in West German Patentschrift 19 14 115, wherein the wall surface of the housing which surrounds the opening roller to define the fiber flow pathway is provided with a separating edge which defines a separating opening at a downstream spacing from the sliver intake location to allow debris to be separated from the fibers of the sliver during the opening process under the effects of centrifugal force created.

Such a separating opening also makes possible the separation and discharge of a dislodged flock of accumulated fibers, but the separating opening cannot serve to prevent the accumulation of fibers and fiber tufts within the housing. In the known sliver feeding and opening devices, fibers typically tend to settle in joints or corners at several locations within the housing of the opening roller, e.g. between the guide plate and the housing as well as at corners formed between housing walls at the lateral sides and about the circumference of the opening roller.

U.S. Pat. No. 3,828,539 (and its counterpart West German Offenlegungsschrift 23 12 169) discloses a sliver feeding and opening device for open-end spinning applications wherein a movable sliver guide member is biased with pressure against the sliver feed roller and further includes an arcuate continuation segment which surrounds a portion of the opening roller. However, the pressure feed member is not pivotably mounted but instead is movably arranged so that the arcuate portion of the pressure feed member is movable only in a generally circular path about the opening roller and, further, the spacing of the feed member from the side walls of the housing is very small so as to form a narrow slot in which fibers may tend to settle and accumulate. If a relatively thick area of the sliver is drawn into the opening device, a danger exists that the device will become overfilled and the opening roller will catch since the arcuate portion of the feed member cannot move away from the opening roller if excess fiber is drawn in by the opening roller.

SUMMARY OF THE INVENTION

It is accordingly an object of the present invention to provide a sliver feeding and opening device for open-end spinning application which will considerably diminish or entirely avoid the settling and accumulation of fibers at joints or corners in the housing, thereby to assure a trouble-free spinning operation.

Briefly summarized, the opening and feeding device of the present invention includes a housing in which a sliver opening roller is rotatably mounted, a sliver feed roller rotatably mounted adjacent the opening roller, suitable means for sliver delivery to the sliver feed roller, and a unitary one-piece guide plate pivotably mounted for movement toward and away from the sliver feed and opening rollers and spring-biased toward the rollers. According to the present invention, the guide plate has a sliver guide portion associated with the sliver feed roller, a fiber guide portion extending from the sliver guide portion along a portion of the circumferential periphery of the opening roller in the direction of its rotation, and a debris guide portion extending from the fiber guide portion outwardly away from the opening roller to terminate outside the fiber transport zone along the periphery of the opening roller. The debris guide portion defines with the housing a debris discharge opening for separation therethrough of debris from the fibers of sliver being opened. Further, the fiber and debris guide portions of the guide plate define with the housing slots therebetween of a dimension which is a multiple of the thickness of the fibers of sliver being opened.

As a result of the described one-piece design and configuration of the guide plate, no joints exist between the constituent portions thereof in which fibers could settle and accumulate. Moreover, the spacing between the guide plate and the housing to form slots of a multiple of the thickness of the sliver fibers also aids in preventing fibers from settling in separating joints of individual parts, at edges or corners of the housing or between relatively movable parts. The possible accumulation of fibers and formation of fiber tufts or flocks, as well as the resultant yarn errors and breaks produced thereby, are avoided.

The formation of the fiber guide portion of the guide plate to partially surround the opening roller along a portion of its circumference provides the considerable advantage of forming an extended guide surface for the sliver fed to the feed roller which holds the sliver against the opening roller as the individual fibers are combed thereby resulting in a uniform combing of the fibers with a constant fiber amount over time.

In the preferred embodiment of the present device, the fiber guide portion of the guide plate is of a width corresponding at least to the axial dimension of the fiber opening extent of the opening roller, i.e. the dimension between end flanges that may be provided on the opening roller, to assure that the fiber flow is guided without disturbance in the housing and that the fibers do not escape out of the housing laterally through the slots between the guide plate and the housing.

The outward extension of the debris guide portion of the guide plate away from the opening roller advantageously positions the debris guide portion outside the vacuum air flow through the housing, which avoids the possibility that the air flow may reentrain debris which has already been separated from the opened fibers.

Preferably, the guide plate includes a relatively sharp edge portion at the juncture between its fiber guide portion and its debris guide portion, which advantageously results in a break in the vacuum air flow through the housing causing small air vortices to form behind the edge portion. These air vortices promote the separation out of small dirt and debris particles from the opened sliver, this effect being designated as air sifting. The flow path of such small debris and dirt particles is disturbed allowing them to fall as a result of gravity with the coarser debris particles into a separation chamber or removal device which may be provided for this purpose.

It is additionally preferred that the sharp edge portion exhibit a back or reverse taper or undercut to prevent a settling of debris or dirt on the edge and thereby also prevent any adverse influence on the vacuum air flow and the fiber transport thereby in this area of the opening roller.

According to another aspect of the present invention, the guide plate may include another debris discharge opening in the fiber guide portion, the opening being of a width corresponding at least to the axial dimension of the opening roller. Relatively coarser debris particles, e.g. sand, husks and the like, may be separated through this opening in advance of the first-mentioned debris discharge opening since the heavier relatively coarse particles are rapidly accelerated radially outwardly from the opening roller due to their relatively greater mass. Thus, this discharge opening in the fiber guide portion of the guide plate enables the opening roller to tangentially cast out the heavier debris particles to achieve an early cleaning of coarse impurities from the opened fibers and better enable centrifugal discharge of smaller debris particles outwardly from the opening roller in an unimpeded manner. The width of the discharge opening in the fiber guide portion enables the coarser debris to be separated out over the entire width of the fiber opening extent of the opening roller.

Advantageously, the debris guide portion of the guide plate is disposed to define a side of the discharge opening in the guide plate, whereby the first-mentioned discharge opening defined between the debris guide portion and the housing and the second-mentioned discharge opening in the fiber guide portion of the guide plate are located in series with one another as viewed in the direction of fiber transport through the housing as determined by the rotational direction of the opening roller. Thus, the separation of the smaller debris and dirt particles performed by air sifting, as aforementioned, is considerably more effective as a result of this arrangement of the discharge openings because the smaller particle separation does not occur simultaneously with, and is therefore not disturbed by, the separation of the coarser debris. Additionally, the collection and removal of the relatively coarse and relatively fine debris particles through the serially adjacent discharge openings is considerably simplified by this arrangement.

It is further preferred that the debris guide portion of the guide plate include a sharp edge at the discharge opening defined in the fiber guide portion of the guide plate to achieve a good separation of the coarse and fine debris particles. The relatively sharp edge essentially divides the portion of the air flow charged with the heavier and coarser debris particles from the remainder of the fiber transporting air flow surrounding the opening roller.

DESCRIPTION OF THE PREFERRED EMBODIMENT

Figure 1:
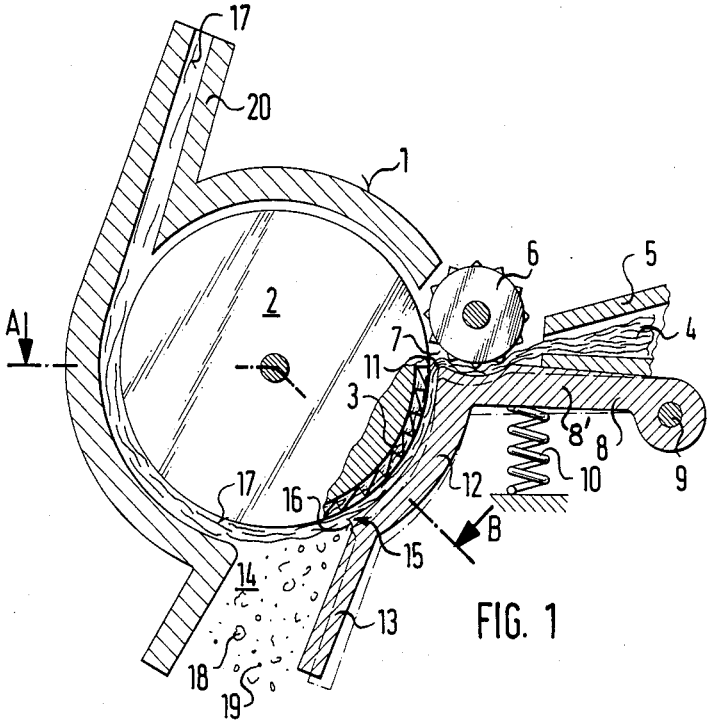
FIG. 1 is a vertical cross-sectional view of a sliver feed and opening device according to the preferred embodiment of the present invention.

Referring now to the accompanying drawings and initially to FIG. 1, one embodiment of the sliver feeding and opening device of the present invention is illustrated, having a housing 1 in which an opening roller 2 is rotatably mounted. The opening roller 2 is provided with a fiber combing component 3 of a saw tooth configuration, which may be formed integrally with the opening roller 2 or as a band affixed to the outer periphery thereof.

A sliver 4 to be opened is fed to the opening roller 2 through an intake opening 7 in the housing 1 via a funnel-like compressor member 5 by a sliver feed roller 6 rotatably mounted adjacent the opening roller 2 at the intake opening 7. A guide plate 8 is pivotably mounted about a shaft 9 and includes a first sliver guide portion 8' extending from the shaft 9 toward the opening roller 2 alongside the sliver feed roller 6, a second fiber guide portion 12 extending from a terminal edge 11 of the sliver guide portion 8' arcuately along a portion of the circumferential periphery of the opening roller 2 in the direction of the rotation thereof, and a third debris guide portion 13 extending from the fiber guide portion 12 outwardly away from the opening roller 2. According to the present invention, the guide plate 8 is of a unitary one-piece construction, whereby its guide portions 8', 12, 13 pivot unitarily toward and away from the sliver feed roller 6 and the opening roller 2, the guide plate 8 being spring-biased as representatively indicated by the spring 10, toward the feed roller 6 and the opening roller 2. In this manner, the sliver 4 is pressed by the sliver guide portion 8' of the guide plate 8 against the serrated surface of the feed roller 6 which, in turn, causes the sliver 4 to be fed along the sliver guide portion 8' to the opening roller 2 which operates to draw the fibers of the sliver 4 from the edge 11 of the sliver guide portion 8' in a combing-like manner.

The debris guide portion 13 of the guide plate 8 cooperates with the housing 1 to define a debris discharge opening 14 through which dirt and debris in the sliver may be separated from the individual fibers thereof, as hereinafter described. Since the sliver, fiber and debris guide portions 8', 12, 13 of the guide plate 8 are formed as aforementioned as an integral one-piece component, no joints exist between the differing guide portions 8', 12, 13 in which individual fibers could catch and cause an accumulation of a flock of fibers. The unitary pivotability of the sliver, fiber and debris guide portions 8', 12, 13 of the guide plate 8 is illustrated in FIG. 1 by the representation in broken lines of a moved position of the guide plate 8. The juncture between the fiber guide portion 12 and the debris guide portion 13 of the plate 8 is formed as a relatively sharp edge 15 exhibiting a reverse or back taper 16.

As the teeth of the combing component 3 of the opening roller 2 grasp and comb individual fibers 17 from the sliver 4 at the terminal edge 11 of the sliver guide portion 8', the individualized fibers 17 are entrained by the air flow prevailing in the housing 1 generated by the vacuum in the spinning chamber of the associated open-end spinning device (not shown). While the relatively lighter fibers 17 follow the vacuum air flow, the heavier and coarser dirt and debris particles 18 as well as smaller dust-like particles 19 which nevertheless are heavier than the fibers 17 tend to be discharged tangentially outwardly from the opening roller 1 and from the housing 1 through the discharge opening 14 under the centrifugal force created by the rotation of the opening roller 2. The discharged debris particles 18, 19 pass from the opening 14 into a suitable device for catching or removing the debris, which device is not shown or described in greater detail herein. The individualized combed fibers 17 continue through the housing 1 past the discharge opening 14 under the entrainment of the vacuum air flow and are discharged via a guide conduit 20 os the housing 1 into the spinning chamber of the associated open-end spinning device.

Figure 2:
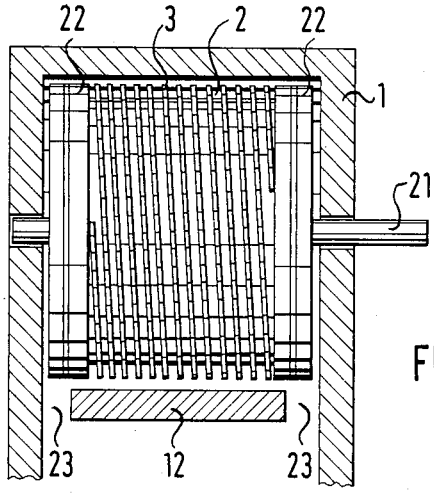
FIG. 2 is a horizontal cross-sectional view of the sliver feeding and opening device of FIG. 1, taken through the housing along line A-B with the opening roller being unsectioned.

As seen in FIG. 2, the opening roller 2 is rotatably mounted in the housing 1 by a shaft 21 in a suitable manner which need not be shown or described in greater detail herein. As illustrated, the opening roller 2 is provided on its circumference with a spirally arranged saw tooth band 3, as aforedescribed. Lateral flanges 22 are affixed to the opposite axial ends of the opening roller 2 to prevent the individualized fibers from escaping from the opening roller 2 and settling between the roller 2 and the sidewalls of the housing 1. As seen in FIG. 2, the fiber guide portion 12 of the guide plate 8 not only extends arcuately along a portion of the circumference of the opening roller 2 but also is of a lateral widthwise dimension slightly greater than the fiber opening extent of the opening roller 2 to extend laterally within the housing 1 to approximately the middle of each flange 22 while still being spaced from the sidewalls of the housing 1 sufficiently to define slotted openings 23 between each lateral side of the guide portion 12 and the housing 1 of a lateral dimension which is a multiple larger than the diameter of the individualized fibers 17. Accordingly, the fiber guide portion 12 of the guide plate 8 is sufficiently wide to substantially retain the individualized fibers 17 entrained within the air flow to pass through the housing 1 into the associated open-end spinning device, while the slots 23 are sufficiently wide at each side of the fiber guide portion 12 to prevent fibers from being able to settle and accumulate in the slots 23.

Figure 3:
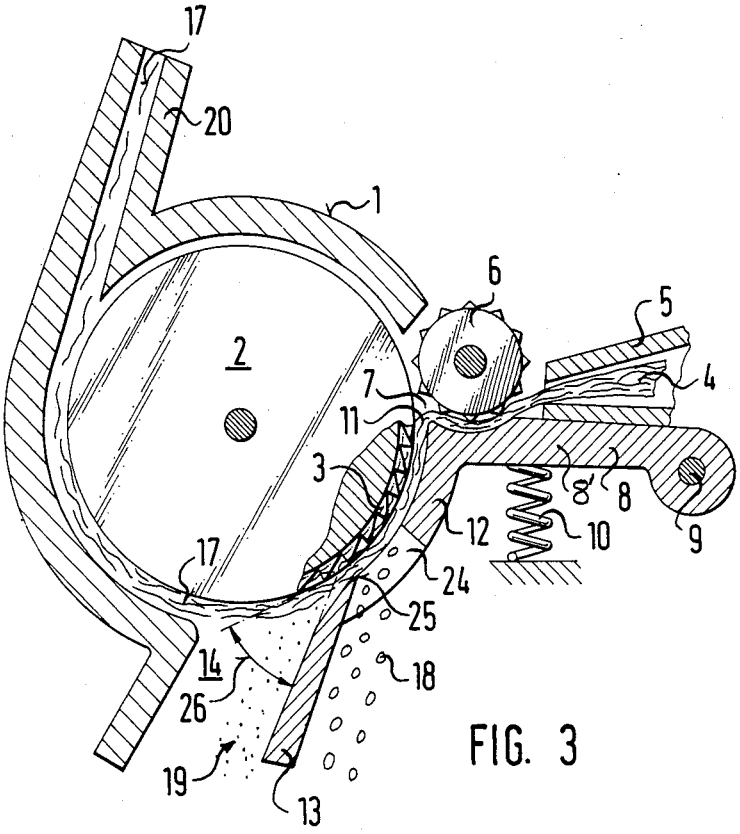
FIG. 3 is another vertical cross-sectional view of a sliver feeding and opening device according to an alternate embodiment of the present invention.

Referring now to FIG. 3, another embodiment of the sliver feeding and opening device of the present invention is illustrated, wherein corresponding components are identified by the same reference numerals as utilized in FIGS. 1 and 2. The feeding and opening device of FIG. 3 differs from the embodiment of FIG. 1 in that the fiber guide portion 12 of the guide plate 8 is formed with an additional debris discharge opening 24. Hereagain, the guide plate 8 is unitarily formed so that the fiber guide portion 12 is an integral part of the guide plate 8 without any joints being formed between the fiber guide portion 12 and other portions of the guide plate 8. The fiber guide portion 12 of the guide plate 8 has a sufficient extent from the sliver guide portion 8' circumferentially along the opening roller 2 to the discharge opening 24 to insure that the opening roller 2 is enabled to engage and comb the fibers 17 from the sliver guide portion 8' in parallelized fashion for entrainment in the vacuum air flow within the housing 1. At the same time, this circumferential extent of the fiber guide portion 12 insures that any debris particles in the sliver 4 are accelerated sufficiently by the rotation of the opening roller 2 to be centrifugally carried outwardly toward the fiber guide portion 12. As will be understood, coarser and heavier debris particles 18, e.g. sand and husk remnants, are centrifugally accelerated more vigorously than lighter and finer dust-like particles 19 so that the coarser and heavier particles 18 are centrifugally directed outwardly into the area of the fiber guide portion 12 earlier than the lighter, finer particles 19 so that the coarser and heavier particles 18 will separate from the fibers 17 and the finer and lighter particles 19 through the discharge opening 24 in the fiber guide portion 12 after traveling only a short distance along the opening roller 2 from the sliver guide portion 8' of the guide plate 8. Finer and lighter dust-like particles 19 will be separated through the opening 14 by the aforedescribed air-sifting technique. In this manner, the coarser, heavier particles 18 may be collected and removed separately from the finer, lighter particles 19.

In this embodiment of the present invention, the debris guide portion 13 of the guide plate 8 should be oriented at a relatively acute angle with respect to a tangent to the opening roller 2, as indicated by the angle 26 in FIG. 3, in order to achieve a proper debris discharge through each of the discharge openings 14 and 24. If the angle 26 is greater than 90 degrees, a danger exists that coarser and heavier debris particles 18 discharged through the opening 24 may rebound off the debris guide portion 13 back into the housing 1 and possibly be reentrained in the fiber air flow.

A particularly good separation of coarser and heavier debris particles 18 from the fiber entraining air flow is achieved by orientation of the debris guide portion 13 to define the downstream side of the debris discharge opening 24 and formation of the debris guide portion 13 with a sharpened knife-like edge 25 at the juncture between the debris guide portion 13 and the fiber guide portion 12. The sharpened knife-like edge 25 substantially divides the entraining air flow through the housing to divert the outer air flow along the fiber guide portion 12, wherein the coarser and heavier debris particles 18 are carried, from the remainder of the fiber entraining air flow and the debris guide portion 13 then directs the divided portion of the air flow with the coarser and heavier particles 19 through the opening 24 and out of the housing 1. For optimal functioning of the sharpened edge 25 in this manner, an appropriate spacing between the edge 25 and the opening roller 2 should be established, the spacing being readily determinable through experimentation.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. A device for opening sliver into individual fibers and feeding the fibers to an open-end spinning device, comprising a housing, a sliver opening roller rotatably mounted within said housing, a sliver feed roller rotatably mounted adjacent said opening roller, means for sliver delivery to said sliver feed roller, and a unitary guide plate pivotably mounted for movement toward and away from said sliver feed and opening rollers and spring biased toward said rollers, said guide plate having a sliver guide portion associated with said sliver feed roller, a fiber guide portion extending from said sliver guide portion along a portion of the circumferential periphery of said opening roller in the direction of its rotation, and a debris guide portion extending from said fiber guide portion outwardly away from said opening roller, said debris guide portion defining with said housing a debris discharge opening for separation therethrough of debris from the fibers of sliver being opened, said fiber and debris guide portion of said guide plate defining with said housing slots therebetween of a dimension which is a multiple of the thickness of the fibers of sliver being opened.

2. A device for opening sliver into individual fibers and feeding the fibers to an open-end spinning device according to claim 1 and characterized further in that said fiber guide portion of said guide plate is of a width corresponding at least to the axial dimension of said opening roller.

3. A device for opening sliver into individual fibers and feeding the fibers to an open-end spinning device according to claim 1 and characterized further in that said guide plate includes a relatively sharp edge portion at the juncture between its said fiber guide portion and said debris guide portion.

4. A device for opening sliver into individual fibers and feeding the fibers to an open-end spinning device according to claim 3 and characterized further in that said edge portion comprises a reverse taper.

5. A device for opening sliver into individual fibers and feeding the fibers to an open-end spinning device according to claim 1 and characterized further in that said fiber guide portion includes another debris discharge opening of a width corresponding at least to the axial dimension of said opening roller.

6. A device for opening sliver into individual fibers and feeding the fibers to an open-end spinning device according to claim 5 and characterized further in that said debris guide portion of said guide plate defines a side of said another opening.

7. A device for opening sliver into individual fibers and feeding the fibers to an open-end spinning device according to claim 6 and characterized further in that said debris guide portion of said guide plate includes a sharp edge at said another opening.

* * * * *